US007660097B2

(12) United States Patent
Lee

(10) Patent No.: US 7,660,097 B2
(45) Date of Patent: Feb. 9, 2010

(54) DEVICE FOR REMOVING ELECTROSTATIC CHARGES ON AN OBJECT USING SOFT X-RAY

(75) Inventor: Dong-Hoon Lee, Psuan (KR)

(73) Assignee: Sunje Hitek Co., Ltd. (KR)

( * ) Notice: Subject to any disclaimer, the term of this patent is extended or adjusted under 35 U.S.C. 154(b) by 443 days.

(21) Appl. No.: 10/568,211

(22) PCT Filed: Oct. 2, 2003

(86) PCT No.: PCT/KR03/02046

§ 371 (c)(1),
(2), (4) Date: Nov. 13, 2006

(87) PCT Pub. No.: WO2005/018287

PCT Pub. Date: Feb. 24, 2005

(65) Prior Publication Data

US 2007/0103841 A1 May 10, 2007

(30) Foreign Application Priority Data

Aug. 14, 2003 (KR) ..... 10-2003-0056410

(51) Int. Cl.
*H05F 3/00* (2006.01)
*H05F 3/04* (2006.01)

(52) U.S. Cl. ..... 361/213

(58) Field of Classification Search ..... 361/213
See application file for complete search history.

(56) References Cited

U.S. PATENT DOCUMENTS 2,770,033 A * 11/1956 Zarth ..... 228/206
3,012,163 A * 12/1961 Goss ..... 378/138
3,023,492 A * 3/1962 Bristow ..... 428/552
5,528,652 A * 6/1996 Smith et al. ..... 378/65
5,750,011 A * 5/1998 Ohmi et al. ..... 204/164
5,949,849 A * 9/1999 Hirano et al. ..... 378/121
6,118,852 A 9/2000 Rogers et al.

FOREIGN PATENT DOCUMENTS

CN 1619759 A * 5/2005
KR 10-2001-9566 2/2001

* cited by examiner

*Primary Examiner*—Ronald W Leja
(74) *Attorney, Agent, or Firm*—The Farrell Law Firm, LLP

(57) ABSTRACT

A remover of electrostatic charges comprises a head part, a soft X-ray protecting part, and a power controlling part. The head part neutralizes and weakens electrostatic charges of bodies that are objects of removal of electrostatic charges by generating soft X-ray having wavelengths in the range of 1.2 Å~1.5 Å with high energy from a soft X-ray tube, and ionizes gas molecules directly and also removes electrostatic charges in atmosphere of inert gases ($N_2$, Ar). The soft X-ray protecting part wraps the head part and prevents that soft X-ray is leaked from said head part. The power controlling part is connected to the head part and the soft X-ray protecting part electrically and provides target voltage to control the ion generation of filament voltage of a soft X-ray tube and soft X-ray tube with the soft X-ray tube.

10 Claims, 5 Drawing Sheets

DEVICE FOR REMOVING ELECTROSTATIC CHARGES ON AN OBJECT USING SOFT X-RAY

BACKGROUND OF THE INVENTION

1. Field of the Invention

This invention relates to technique about removal of electrostatic charges. Especially, this invention discloses technique about removal of electrostatic charges by using soft X-ray and ceramic having superior thermal characteristics and tungsten in electrostatic charge generating devices in order to remove electrostatic charges effectively.

2. Description of the Related Arts

Generally in LCD, PDP and semiconductor process etc. minute dusts adheres to LCD, PDP and semiconductor wafers according to the generation of electrostatic charges or the dusts cause pattern destruction according to the discharge of electrostatic charges and lowering of yield of products and manufacturing costs increase.

At present in such processes as means for removal of electrostatic charges ion bar and ion blower are used that generate ions by corona discharge but this device generates ions by corona discharge and convects air by fan in order to blow off ionized air. In such processes metallic minute particles under 0.01 μm are generated very much (hundreds of thousands of particles/$ft^3$) at the end part of discharge electrode by the spattering phenomenon according to the high voltage discharge and adhere to it and are separated by forced convection according to a fan and adheres to the surroundings of LCD, PDP and semiconductor patterns to cause inferiority.

$O_3$ gases (ozone) generated by high voltage generation reach 4~10 ppm and accelerate the adherence of minute dusts as well as the balance of generated +ions and −ions changes frequently to readjust the ion balance every time. Accordingly it became necessary to get a new technique to remove electrostatic charges that does not generate minute dusts and does not need air convection.

FIG. 1 illustrates the principle of removal of electricity of typical voltage-applying type electrostatic remover according to the prior art. As shown in the figure high voltage (10) is applied to ion generation discharging electrode and gases near discharge electrode (20) are ionized by corona discharge between discharging body (40) and electrode and + and −ions are generated. At this time electrostatic charges can be neutralized by the generated + or −ions. Here 30 denotes ion groups generated by the above method. Accordingly it became necessary to get a new technique to remove electrostatic charges that does not generate minute dusts and does not need air convection.

On the other hand nowadays bioscience fields grow rapidly with the development of electronic technologies of high precision system and are based on the air cleaning technology for forming a clean room that is almost clear or germless. However if there exists a discharging body in such a clean room, electrostatic charges become a cause of pollution because minute dusts are absorbed and adhere to it by electrostatic force. Accordingly electrostatic charges that absorb dusts and adhere it become one of main elements affecting to yield of products in clean room like LED, PDP and semiconductor processes. Especially in manufacturing of ultra large scale integrated circuit (ULSI), plasma display panel (PDP) and thin film transistor-liquid crystal display (TFT-LCD), electrostatic charges are electrified easily because $SiO_2$ or glass surface is high insulator. Electrostatic charges generated in the processes lower the reliability of products as well as become a direct cause of lowering the yield of products. Like this, the pollution of adherence of floating minute particles according to the electrostatic charges becomes a very big obstacle to fine processing techniques of semiconductors and only a little pollution may cause a serious affect to the characteristics of semiconductors. Accordingly the necessity of a new charge removing method in order to remove electrostatic charges is rising.

U.S. Pat. No. 5,949,849 is a prior art of this field. This patent relates to an electrostatic charge remover using X-ray generator. A electrostatic charge remover according to this patent has a protective case, an X-ray tube generating soft X-ray, power source device and the X-ray tube has a bulb, a cathode, an output window, an output support, a flange portion, a target and the inner components of the X-ray tube and the protective case are connected thermally and electrically.

Japanese patent 2951477 is another prior art of this field. This patent relates to an electrostatic charge removing technique and removes electrostatic charges of a predetermined charged body under the circumstances including the ions by having a target at inner part of itself, to which a predetermined target voltage and current are given at a position where X-ray is irradiated as for circumstances where a predetermined charged body is arrayed as well as arranging an X-ray tube having a Be window and ionizing elements included in the circumstances of the area, on which X-ray having main wavelength in the range of 2 Å~20 Å is irradiated from the Be window.

However in the above prior arts the wavelengths of generated X-ray was long and the thermal characteristics of an X-ray generating device was not superior.

SUMMARY OF THE INVENTION

A preferable embodiment of an electrostatic charge remover using soft X-ray comprises:

a head part neutralizing and weakening electrostatic charges of bodies that are objects of removal of electrostatic charges by generating soft X-ray having wavelengths in the range of 1.2 Å~1.5 Å with high energy from a soft X-ray tube that is an ion generating tube using thin film of Be evaporated with W as window material, and ionizing gas molecules directly and also removing electrostatic charges in atmosphere of inert gases ($N_2$, Ar);

a soft X-ray protecting part wrapping said head part and preventing that soft X-ray is leaked from said head part in order that worker may not be bombed by radiation;

a power controlling part being connected to said head part and said soft X-ray protecting part electrically and providing target voltage to control the ion generation of filament voltage of a soft X-ray tube and soft X-ray tube with the soft X-ray tube in order to control the ion generation so that said head part may generate soft X-ray appropriately, and wherein it is characterized in that said remover removes the electrostatic charges on the surface of charged bodies by generating ions or electrons by ionizing gases surrounding charged bodies.

It is preferable in the present invention that said soft X-ray protecting part is made of iron plates with thickness of 1 mm and an interlock switch controlling whether said power controlling part operates or not and a door putting on/off said interlock switch are installed in said soft X-ray protecting part for safety and in a state said door is opened, said head part does not generate soft X-ray.

It is preferable in the present invention that said power controlling part controls anode voltage (target voltage) and filament current by using PWM modulator and pulse width controlling method and switches to a frequency of 30 KHz by constructing a half bridge circuit with FET and the PWM modulator and the half bridge circuit are mounted for filament power and anode voltage generation respectively.

It is preferable in the present invention that anode voltage generating part of said power controlling part is fed-back through tube voltage sensor and makes a target operate at constant voltage of 9.5 KV and a separated transformer being a constant voltage source device to a filament current is fed-back through a filament current sensor and a tube current sensor and makes a filament operate at constant current of 150 μA and current is fed-back through a tube current sensor and the generated quantity of the soft X-ray does not change although it is used for a long time.

It is preferable in the present invention that said anode voltage generating part of said power controlling part comprises:

a high transformer generating high voltage;

a tube voltage sensor detecting high voltage generated by said high transformer;

a high voltage doubling rectifier, wherein voltage is fed-back to said rectifier through said tube voltage sensor and said rectifier operates at a constant voltage;

a transformer generating filament current;

a filament current sensor detecting filament current generated by said transformer; and a part inletting electric wires by insulating from high voltage and fixing ceramic soft X-ray tube.

It is preferable in the present invention that said soft X-ray tube consists of vacuum tubes for generating soft X-ray by generating ions and a ceramic tube is used for controlling heat generation of said soft X-ray tube.

It is preferable in the present invention that the effective maximum installation distance of said electrostatic remover is 2000 mm.

It is preferable in the present invention that said remover ionizes surrounding gases near a charged body to generate ions or electrons and removes electrostatic charges on the surface of said charged body.

A preferable embodiment of a soft X-ray tube manufacturing method used in an electrostatic charge remover using soft X-ray removes electrostatic charges on the surface of a charged body by generating ions or electrons after irradiating lights with high energy (wavelength in the range of 1.2 Å~1.5 Å) and ionizes gaseous molecules directly to remove electrostatic charges in inert gases too and ionizes the surrounding gases near the charged body, and the method comprises the steps for:

painting Mo—Mn paste with silk screen on ceramics to get metallizing coat of a ceramic tube and then heating Mo—Mn paste under hydrogenous circumstances at 1,350° C. for two hours and cooling said heated Mo—Mn paste;

plating non-electrolytic nickel on said metallized surface after said cooling;

deciding a filament's diameter according to the quantity of electrons to be generated after said nickel plating and turning the filament around a round steel bar predetermined times and pulling the bar out of the filament and coating the filament with LaBaO;

coating anode material on a Be window plate after said LaBaO coating, wherein the edge to be brazed is left not to be coated and accordingly filler metal consisting of Ag of 73% an Cu of 27% flows over said coated anode surface and prevents the efficiency from dropping;

coating W over the Be window plate by using a filtered vacuum arc source (FVAS) coating device after said anode material coating;

performing high vacuum brazing by using an exclusive vacuum furnace and heating up temperature up to 900° C. by using a Mo heater and increasing degree of vacuum up to $4\times10^{-7}$ Torr by using a turbo molecular pump and a rotary pump;

making vacuum exhaustion of a tube up to a predetermined degree smoothly in case of brazing junction and making every material melt and form a body if temperature is over a melting point and embossing filler metal and brazing said embossed filler metal in order to keep the degree of vacuum as high as possible; and inserting a getter that is degassed at 450° C. as a non evaporable getter consisting of Zr—Ni—V—Fe material positioning near an inner cathode and activated in order to increase the life of tube.

It is preferable in the present invention that said getter is fixed on the outer surface of a Ti cylinder of a cathode by welding in case of attaching a filament and said activated getter absorbs gases generated at the inner space of a closed tube and accordingly the degree of vacuum is kept for a long time and the life of said tube is prolonged.

It is preferable in the present invention that target voltage is 9.5 KV and filament is 150 μA in order to generate soft X-ray.

BRIEF DESCRIPTION OF THE DRAWINGS

An object of the present invention in order to solve the problems of the prior arts operating as in the above is to provide a device for removing electrostatic charges on objects using soft X-ray the characteristic wavelength of that is 1.2 Å and that is suitable for removing electrostatic charges stored on the surfaces of glass breadboards and wafers among clean rooms like LCD, PDP and semiconductor processes.

The particular features and advantages of the invention as well as other objects will become apparent from the following description taken in connection with the accompanying drawings, in which.

Figure 1:
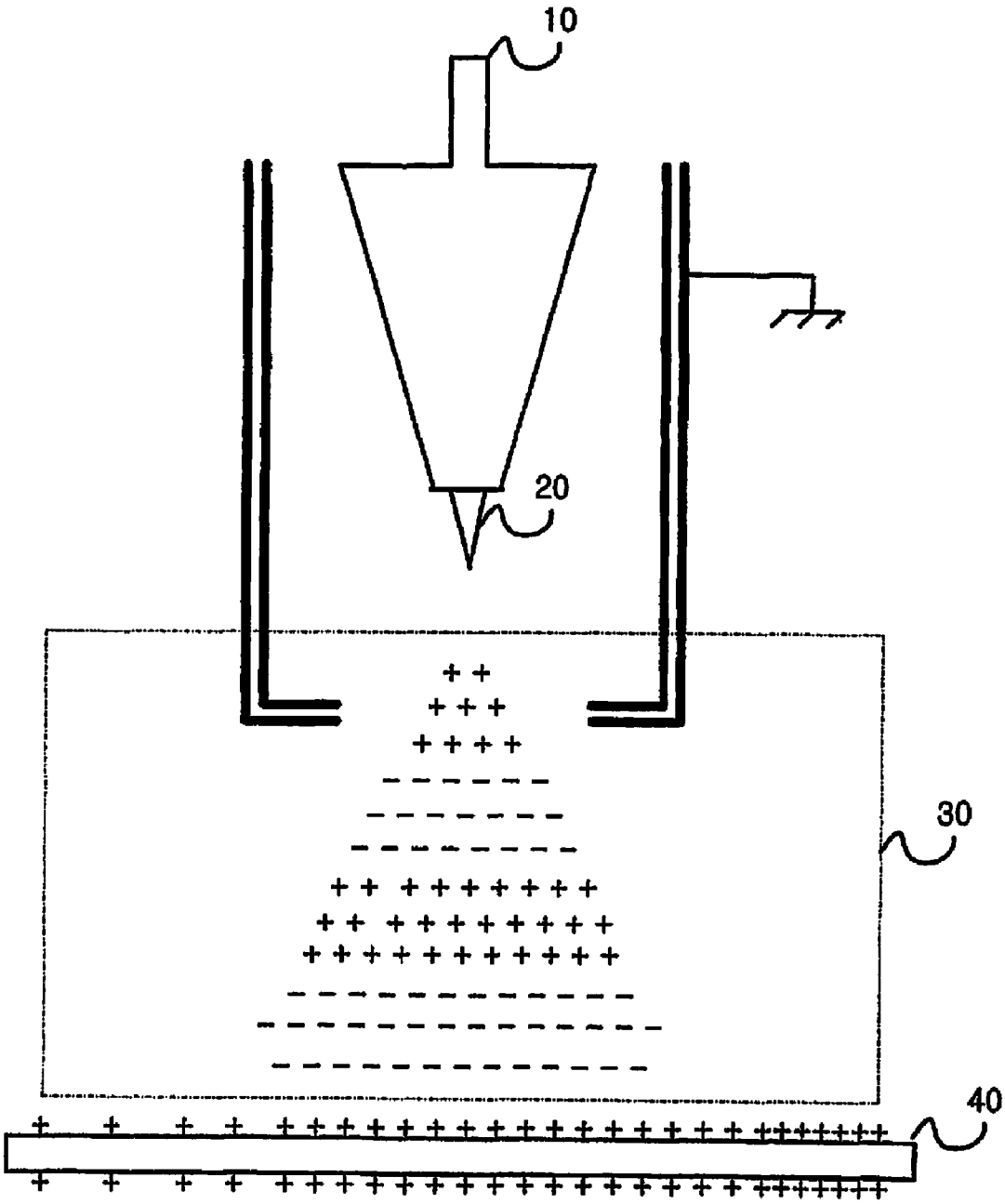
FIG. 1 PRIOR ART
FIG. 1 illustrates the principle of removal of electricity of voltage-applying type electrostatic remover according to the prior art.

Simple Explanation About Important Parts of Drawings

10: AC high voltage
20: discharge electrodes
30: ion group
40: a charged body
100: a head part
150: ion generating tube
151: a Window part
152, 154, 158: Filler metal ring
153: Anode plate
155: Ceramic cylinder
156: Titanium foil cylinder
157: Tungsten filament
159: Ceramic pin head

200: soft X-ray protecting part
210: door
220: interlock switch
300: power control part
310: PWM modulator
320: FET Bridge circuit part
330: Filament current sensor part
340: high voltage transformer (Target power part)
350: high voltage rectifier (Target power rectifier)
360: separated transformer (Filament power part)
370: tube voltage sensor (Target voltage sensor part)
380: tube currant sensor (Target current sensor part)
390: Reference comparator
400: optical ionization device
S410: stabilized atomic/molecular state
S420: a state where weak X-ray collides with stabilized atoms/molecules
S430: a state where stabilized atoms/molecules have +ions
S440: a state where electrons combine with stabilized atoms/molecules
S450: a state where atoms/molecules combined with electrons have −ions

DESCRIPTION OF THE PREFERRED EMBODIMENTS

1. The Structure of the Invention

A device for removing electrostatic charges on objects using soft X-ray according to the present invention comprises a head part (100), a soft X-ray protecting part (200), and a power controlling part (300). The head part (100) neutralizes and weakens electrostatic charges of bodies that are objects of removal of electrostatic charges by generating soft X-ray having wavelengths in the range of 1.2 Å~1.5 Å with high energy from a soft X-ray tube that is an ion generating tube using thin film of Be evaporated with W as window material, and ionizes gas molecules directly and also removes electrostatic charges in atmosphere of inert gases ($N_2$, Ar). The soft X-ray protecting part (200) wraps the head part and prevents that soft X-ray is leaked from said head part in order that worker may not be bombed by radiation. The power controlling part is connected to the head part and the soft X-ray protecting part electrically and provides target voltage to control the ion generation of filament voltage of a soft X-ray tube and soft X-ray tube with the soft X-ray tube in order to control the ion generation so that the head part may generate soft X-ray appropriately.

It is characterized in that the invention removes the electrostatic charges on the surface of charged bodies by generating ions or electrons by ionizing gases surrounding charged bodies.

It is characterized in that the soft X-ray protecting part is made of iron plates with thickness of 1 mm and interlock switch controlling whether the power controlling part operates or not and door putting on/off the interlock switch are installed in the soft X-ray protecting part for safety and in a state the door is opened, the head part does not generate soft X-ray.

It is characterized in that the power controlling part controls anode voltage (target voltage) and filament current by using PWM modulator and pulse width controlling method and switches to a frequency of 30 KHz by constructing half bridge circuit with FET and the PWM modulator and half bridge circuit are mounted for filament power and anode voltage generation respectively.

It is characterized in that anode voltage generating part of the power controlling part is fed-back through a tube voltage sensor and makes a target operate at constant voltage of 9.5 KV and a separated transformer being a constant voltage source device to a filament current is fed-back through a filament current sensor and a tube current sensor and makes a filament operate at constant current of 150 μA and current is fed-back through a tube current sensor and the generated quantity of the soft X-ray does not change although it is used for a long time.

It is characterized in that the anode voltage generating part of the power controlling part comprises a high transformer generating high voltage, a tube voltage sensor detecting high voltage generated by the high transformer, a high voltage doubling rectifier, wherein voltage is fed-back through the tube voltage sensor and the rectifier operates at a constant voltage, a transformer generating filament current, a filament current sensor detecting filament current generated by said transformer, a part inletting electric wires by insulating from high voltage and fixing ceramic soft X-ray tube.

It is characterized in that the soft X-ray tube consists of vacuum tubes for generating soft X-ray by generating ions and ceramic tube is used for controlling heat generation of soft X-ray tube.

It is characterized in that the effective maximum installation distance of the electrostatic remover is 2000 mm and the remover ionizes the surrounding gases near a charged body to generate ions or electrons and removes electrostatic charges on the surface of the charged body.

On the other hand, a soft X-ray tube manufacturing method used in an electrostatic charge remover using soft X-ray removing electrostatic charges on the surface of a charged body by generating ions or electrons after irradiating lights with high energy (wavelength in the range of 1.2 Å~1.5 Å and ionizing gaseous molecules directly to remove electrostatic charges in inert gases too and ionizing the surrounding gases near the charged body. And the method comprises a step (s20) for painting Mo—Mn paste with silk screen on ceramics to get metallizing coat of a ceramic tube and then heating the Mo—Mn paste under hydrogenous circumstances at 1,350° C. for two hours and cooling it, a step (s40) for plating non-electrolytic nickel on the metallized surface after the cooling, a step (s60) for deciding a filament's diameter according to the quantity of electrons to be generated and turning the filament around a round steel bar predetermined times and pulling the bar out of the filament and coating the filament with LaBaO after the nickel plating, a step (s80) for coating anode material on a Be window plate after the coating, wherein the edge to be brazed is left not to be coated and accordingly filler metal consisting of Ag of 73% and Cu of 27% flows over the coated anode surface and prevents the efficiency from dropping, a step (s100) for coating W over the Be window plate by using a filtered vacuum arc source (FVAS) coating device after the anode material coating, a step (s120) for performing high vacuum brazing by using an exclusive vacuum furnace and heating up temperature up to 900° C. by using a Mo heater and increasing the degree of vacuum up to $4\times10^{-7}$ Torr by using a turbo molecular pump and a rotary pump, a step (s140) for making the vacuum exhaustion of a tube up to a necessary degree smoothly in case of brazing junction and making every material melt and form a body if it is over melting point and embossing filler metal and brazing it in order to keep the degree of vacuum as high as possible, a step (s160) for inserting a getter that is degassed at 450° C. as a non evaporable getter consisting of Zr—Ni—V—Fe material positioning near an inner cathode and activated in order to increase the life of the tube.

It is characterized in that the getter is fixed on the outer surface of a Ti cylinder of a cathode by welding in case of attaching a filament and the activated getter absorbs gases generated at the inner space of a closed tube and accordingly the degree of vacuum is kept for a long time and the life of the tube is prolonged.

And target voltage is 9.5 KV and filament current is 150 μA in order to generate soft X-ray.

2. A Preferable Embodiment of the Present Invention

To solve the problems described above, the invention ionizes oxygen and nitrogen molecules under surrounding atmosphere by using air ionization of soft X-ray (wavelength in the range of 1.2 Å~1.5 Å) and eases generation of electrostatic charges of an object body whose electrostatic charges should be removed. Because an electrostatic remover according to the present invention doesn't make dust particles and it is not necessary to convect air, the remover is suitable to manufacturing processes of LCD, PDP and semiconductors.

The present invention is a soft X-ray type electrostatic remover adopting ceramic tube relates to X-ray electrostatic remover and uses ceramic penetrating positive polarized X-ray tube, which is the whole body of positive polarity and X-ray window, and as a result it is capable of repressing generated heat therefore it has small bulk and high efficiency of soft X-ray generation compared to a glass tube type X-ray tube and can be driven by a small power source device. A soft X-ray electrostatic remover adopting ceramic tube, in the manufacturing process of LCD, PDP and semiconductor, prevents damage of elements from electrostatic charge and improves not only yield but also manufacturing technology of LCD and semiconductors.

A preferable embodiment of X-ray electrostatic remover according to the present invention comprises a head unit (100) neutralizing and weakening electrostatic charge on an object by generation of soft X-ray ray (wavelength in the range of 1.2 Å~1.5 Å), a soft X-ray protector (200) protecting said head unit and preventing leakage of soft X-ray at said head unit and a power control unit (300) supplying control signal and control voltage to said head unit so as to control ion generation for adequate soft X-ray generation from said head unit.

To solve the problems of the prior arts, an object of the present invention is to provide a soft X-ray electrostatic remover having different basic principles with corona discharge type. A soft X-ray electrostatic remover according to the present invention has different principle of ion generation basically with corona discharge type electrostatic remover.

A structure and operation of a soft X-ray electrostatic remover according to the present invention will be described while referring to the accompanying drawings.

Figure 2:
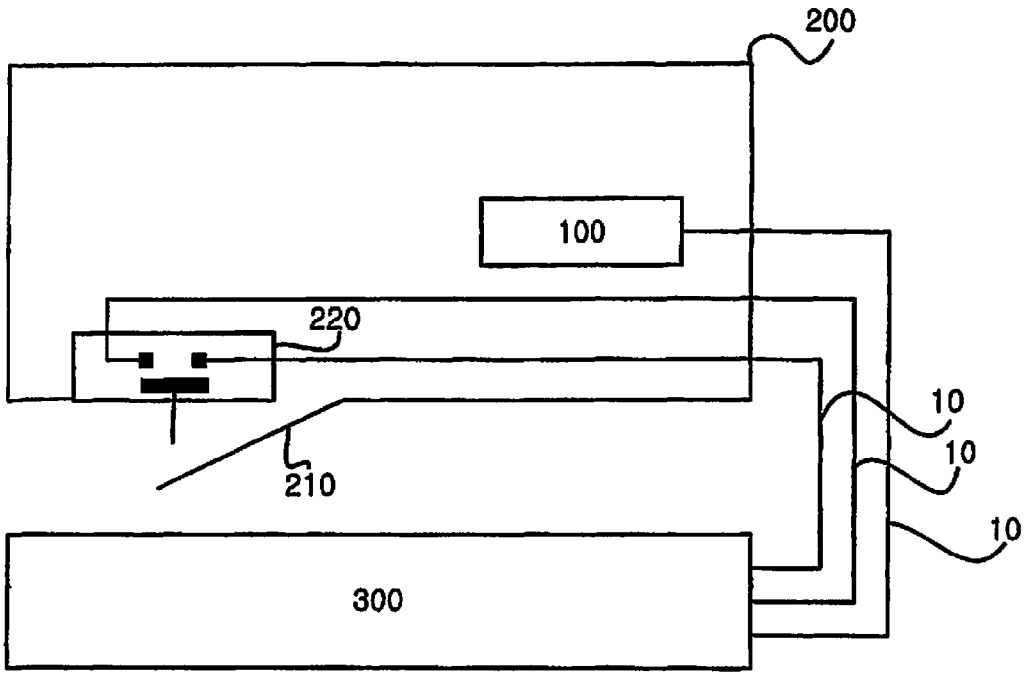
FIG. 2 PRIOR ART
FIG. 2 illustrates the structure of a device for removing electrostatic charges on an object using soft X-ray according to an embodiment of the present invention.

FIG. 2 is a block diagram showing an embodiment of a soft X-ray electrostatic remover structure comprising, as shown in FIG. 2, a head unit (100) generating soft X-ray, a soft X-ray protector (200) protecting said head unit (100) so as to prevent workers from being exposed to the radiation due to leakage of soft X-ray at said head unit (100) and a power control unit (300) connected with the head unit (100) and the soft X-ray protector (200) electrically and controlling soft X-ray generation from said head unit (100).

Said soft X-ray protector (200) preventing leakage of soft X-ray is formed of iron plate having thickness of 1 mm and for safety has an interlock switch (220) controlling operation of said power control unit (300) and a door (210) controlling on/off of said interlock switch (220) and thereby said head unit (100) does not generate soft X-ray while said door (210) is opened. Said head unit (100) generates soft X-ray by using soft X-ray tube and said power control unit (300) supplies voltage to said soft X-ray tube.

Figure 3:
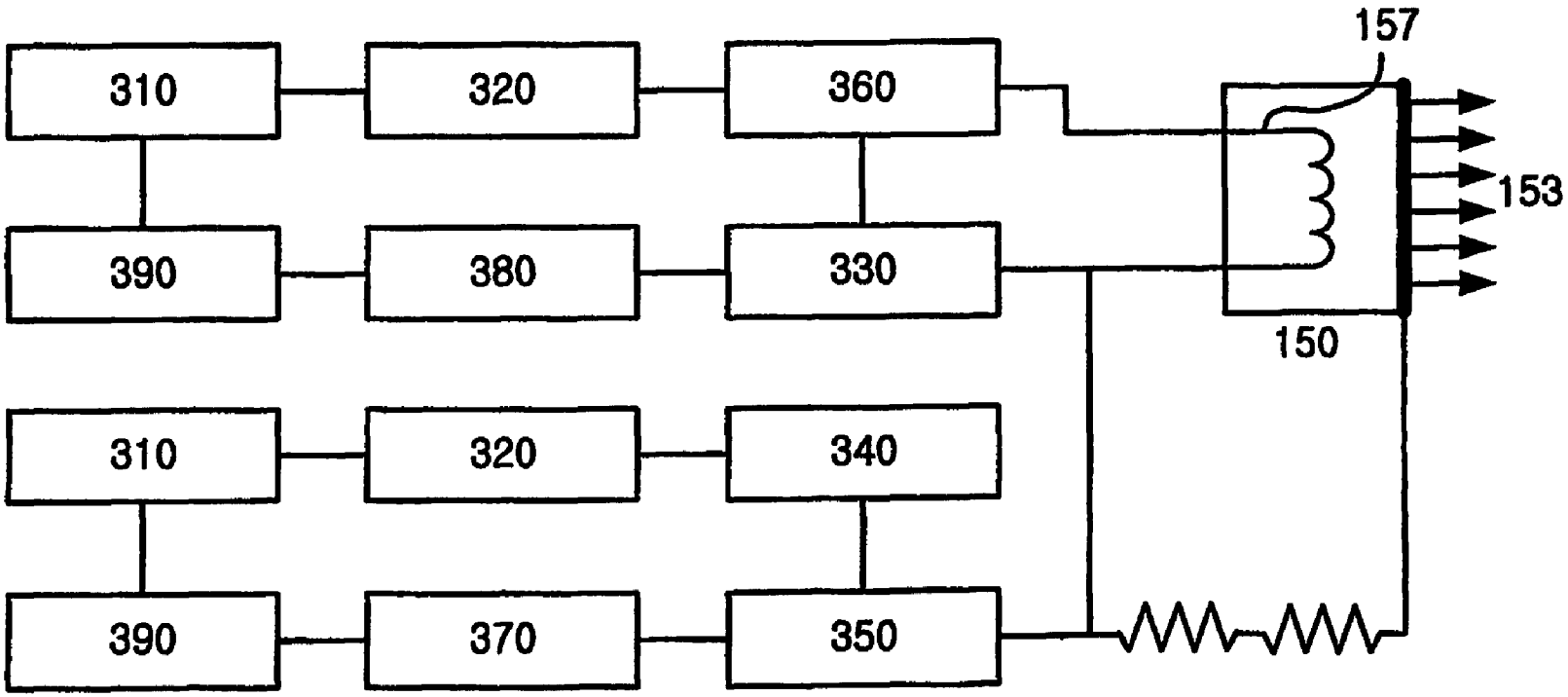
FIG. 3 illustrates a block diagram of an embodiment of the structure of a power control part according to the present invention.

FIG. 3 is a block diagram showing a preferable embodiment of power control unit (300) structure according to the present invention. As shown in FIG. 3, it supplies a target voltage of 9.5 kV so as to control ion generation of soft X-ray tube (150) and filament voltage of +3V DC of soft X-ray tube (150). The operation and effects of power control unit according to the present invention will be described in detail.

According to the present invention, pulse width modulator (e.g. LT3526 PWM IC) (310) controls anode voltage (target voltage) and filament current with pulse width control method, and half bridge circuit (320) consists of FET (e.g. IRFP640) and performs switching at the frequency of 30 kHz. PWM modulator (310) and half bridge circuit are equipped respectively by one for using as generator of filament power and anode voltage.

At the present invention to high voltage transformer (340) and high voltage-doubling rectifier (350), being anode voltage generator units, voltage is fed back by tube voltage sensor (370) and the voltage operates as static voltage of 9.5 kV. On the other hand, to an isolated transformer (360), which is a source of filament static voltage, current is fed back by tube current sensor (380) and operates as static current of 150 μA.

If the diameter of filament becomes small, filament (157) temperature rises and it will cause quick disconnection of filament on the contrary of the case using static voltage. Accordingly, in the present invention, though tube current is fed back through tube current sensor (380) for a long time, the generation quantity of soft X-ray does not change.

Anode voltage generator unit comprises a high voltage transformer (340) generating high voltage, a high voltage doubling rectifier (350), a transformer (360) generating filament current, a filament current sensor (330), a tube voltage sensor (370) sensing tube voltage, a tube current sensor (380) sensing tube current and a part fixing ceramic soft X-ray tube and insulating electrical wires from high voltage and inletting them. Both of a high voltage transformer (340) generating high voltage and a transformer (360) generating filament current is transformer for high voltage, and, in this embodiment, a power of about 7 W is needed. Here 153 is anode plate.

Said soft X-ray tube (150), which is an ion generation tube, consists of a vacuum tube generation ions and generating soft X-ray and so as to generate soft X-ray the tube has a target (or window) using material, which is made by evaporating W (tungsten) to thin film of Be (beryllium).

Said soft X-ray tube (150) comprises a soft X-ray tube that contains filament (157) and metal target (Be+W) and a high voltage generator unit. The soft X-ray is generated by collision of electrons to the metal target, wherein the electrons are generated by said filament (157) and accelerated by said high voltage generator unit. And 390 is a reference comparator.

Figure 4:
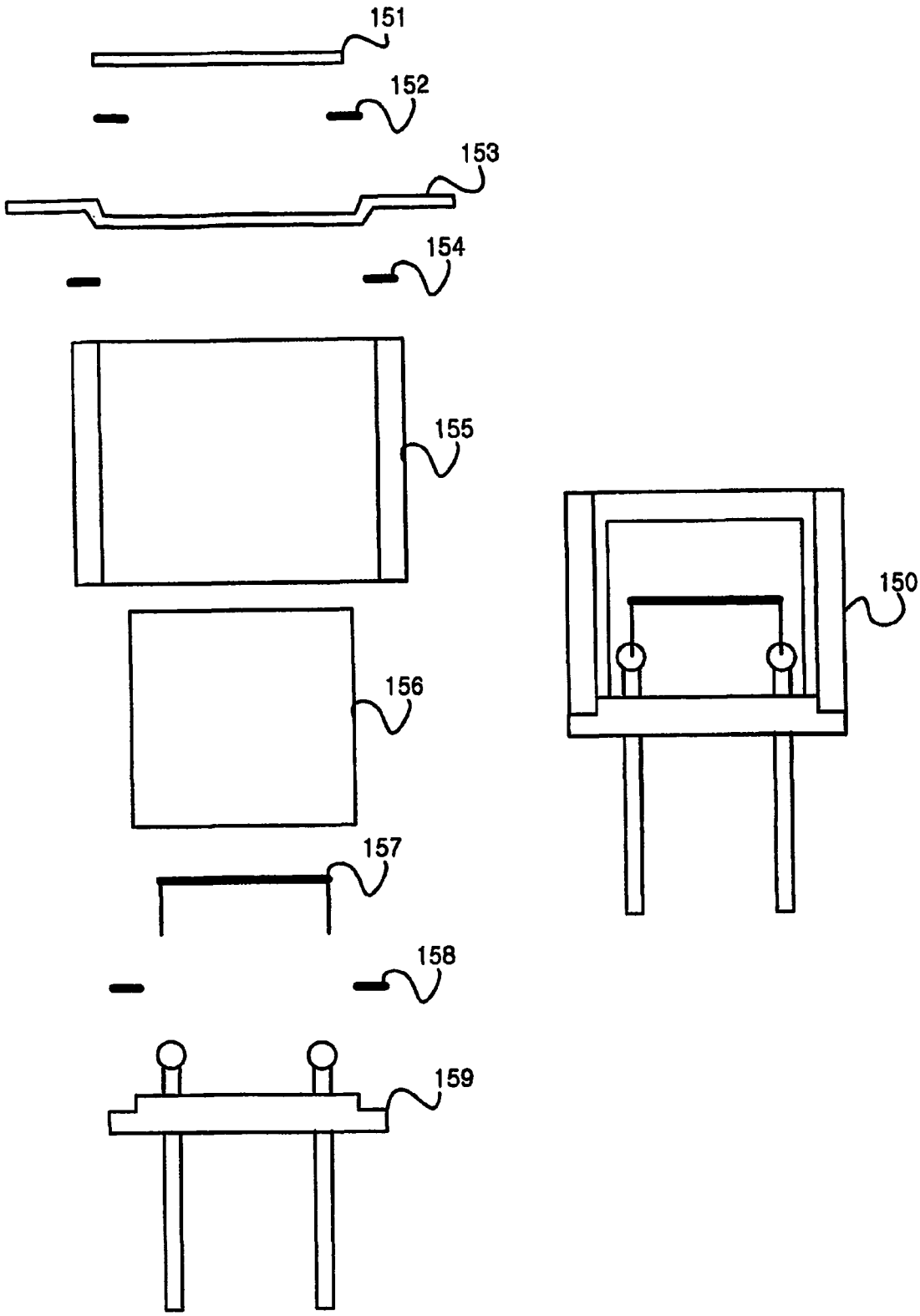
FIG. 4 illustrates the inner structure of soft X-ray tube used in the present invention.

Hereinafter the operation and effects of an ion generation tube (150) according to the present invention will be described. FIG. 4 shows in turn the arranged parts of ceramic transmission positively polarized soft X-ray tube and the soft X-ray tube can be manufactured through several processes described in the following.

Metallized film of ceramic cylinder (155) is obtained by painting Mo—Mn paste with silk screen on ceramic heating at 1,350° C. for 2 hours in hydrogen atmosphere and cooling it. When brazing, so as to increase wetness degree, the metallized surface is plated with non-electrolytic nickel.

Tungsten filament (157) is decided by the quantity of electrons to be generated and in the embodiment of this invention the filament having a diameter of 0.125 mm is used and it is wound 12 turns around a steel bar having a diameter of 1 mm and the steel bar is removed and the filament is coated with LaBaO.

Coating on the beryllium window plate (151) with anode material, the edge part to be brazed is not coated so as to prevent decrease of efficiency due to the inflow of filler metalling (152) consisted of silver (Ag) of 73% and copper (Cu) of 27% onto the surface coated with anode material. In coating of beryllium window plate (151) with tungsten, FVAS (Filtered Vacuum Arc Source) coating equipment is used. To get a high degree of vacuum brazing, a vacuum furnace is used. Temperature reaches up to 900° C. by molybdenum heater, and vacuum degree reaches up to $4\times10^{-7}$ Torr by turbo molecular pump and rotary pump.

In case of brazing in order to maintain the degree of vacuum in a tube as high as possible filler metal is embossed and then used. It is because in case of brazing junction in order to smoothly exhaust air for vacuum and to maintain high vacuum condition in a tube by melting every material and forming them as a whole body when the inner temperature is over a melting point.

To lengthen life span of a tube, a titanium foil cylinder, i.e. a Getter (156), a non evaporable getter consisted of Zr—Ni—V—Fe and the getter is activated type through degassing at 450° C. is inserted into the circumferences of an inner negative pole of the tube. When a filament is attached, a getter is fixed to the outer surface of Ti cylinder of negative pole by spot welding and when brazing is made, it is activated at a temperature of above 450° C. in the high vacuum condition and the activated getter maintains vacuum degree for a long time by absorption of gas generated at a closed tube space and lengthens life span of the tube.

In here, 153 is an anode plate, 154 ad 157 are filler metal rings and 159 is a ceramic pinhead. Assembling 151 to 159 in turn makes 150.

Figure 5:
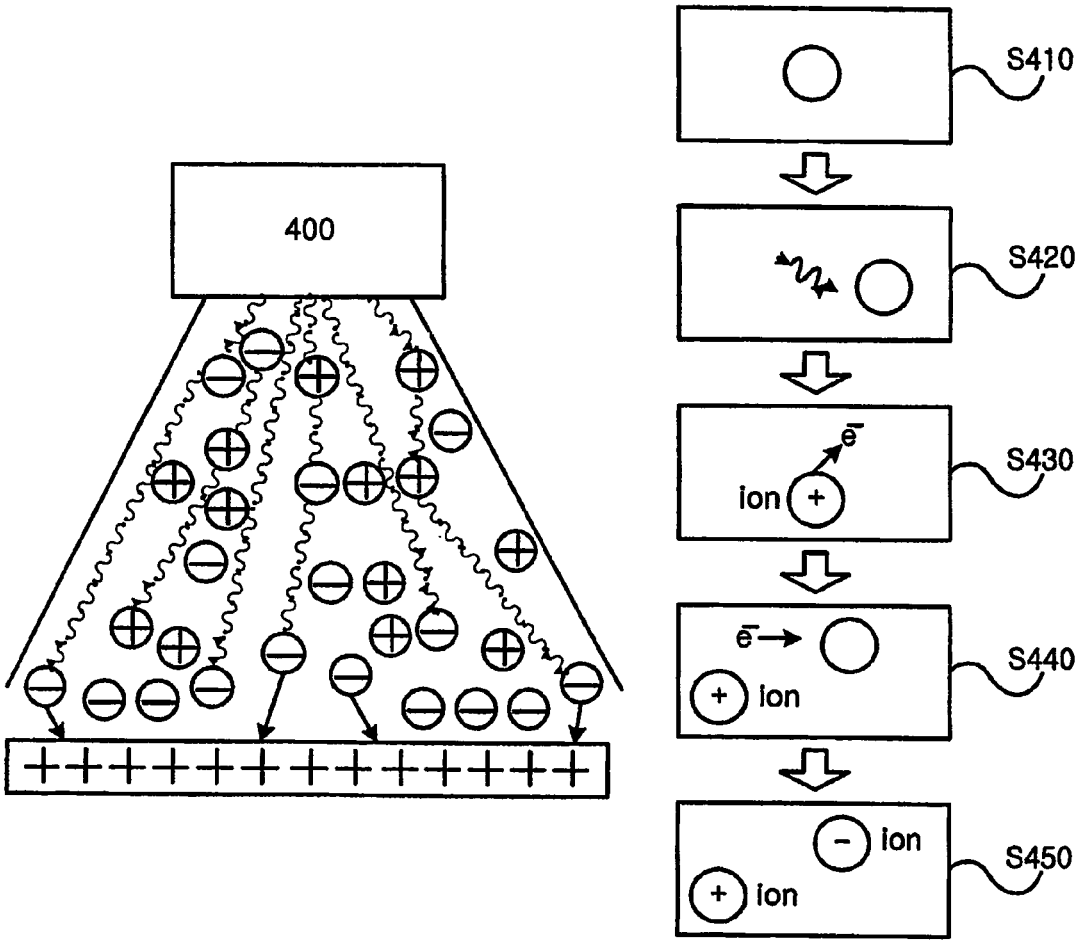
FIG. 5 illustrates the ion generating principle of the soft X-ray generator applied to the present invention.

FIG. 5 shows an ion generation principle of soft X-ray generator according to the present invention. S410 shows a stable atomic/molecular condition, S420 shows a collision state of feeble X-ray and stable atomic/molecular, S430 shows a (+) ion state of stable atoms/molecules, S440 shows a bonding state of electrons and stable atoms/molecules and S450 shows (−) an ion state of atoms/molecules bonded with electrons.

As shown, because a soft X-ray generator irradiates light having high energy (a wavelength in the range of 1.2 Å~1.5 Å), electrostatic charges can be removed even in inert gases through ionizing gas molecules directly.

In the present invention, target voltage for generating soft X-ray is 9.5 kV, filament is 150 μA.

The characteristics of soft X-ray electrostatic remover described above is that it takes a very short time to remove electrostatic charge; remaining electrostatic voltage is very low and electrostatic charge can be removed even in inert gases at an atmospheric condition because high density ions can be generated.

An electrostatic remover using soft X-ray ionizes circumferential gases of a charged body and generates ions and removes electrostatic charges from the charged body. Differently from the existing electrostatic remover of corona discharge type requiring air blower in order to returning ions, this remover owing to using soft X-ray can remove electrostatic charges even at a windless circumstance.

Removing ability of a soft X-ray electrostatic remover according to the present invention can be represented by a rate of taken time to decrease a simulated charged voltage up to 10% and ion current. If electrostatic charges are neutralized by ions and electrostatic remover has a good ability to generate a number of ions, then electrostatic charges would be removed in a short time naturally.

Experiments of a soft X-ray electrostatic remover according to the present invention have been carried out about an installing distance between a charged body and electrostatic remover and an installing angle of an electrostatic remover.

Results of the experiments are as followings:

1) Installing distance can be selected according to a charged state of a charged body and the experiment shows that electrostatic charges can be removed effectively up to the installing distance of 2,000 mm.

2) Removing efficiency of electrostatic charges according to changes of the installing angle of an electrostatic remover has not a lot of change but are excellent relatively at an angle of below 115°.

3) The maximum values of ion current generated from a soft X-ray electrostatic remover are +630 nA and −523 nA. The ion current increases up to the installing distance of 100 mm but decreases slowly at the above 100 mm and it decreases up to 17~18 nA at 900 mm.

4) A soft X-ray electrostatic remover according to the present invention does not cause pollution due to corpuscles and dust particles and is suitable for manufacturing processes of such as semiconductors, TFT-LCD or PDP.

A soft X-ray electrostatic remover (or light irradiation type electrostatic remover) according to the present invention ionizes circumferential gases of a charged body and generates ions and removes electrostatic charges on the surface of the charged body. Therefore a soft X-ray electrostatic remover is effective under circumstances of atmospheric inert gases or having oxygen (i.e. air circumstance).

As described above, an electrostatic remover according to the present invention neutralizes or mitigates electrostatic charges generated from the manufacturing processes of an object needing electrostatic remove such as combustible powder, paints, LCD, PDP and semiconductors, and uses soft X-ray.

Therefore an electrostatic remover according to the present invention has the following advantages compared to a corona discharge type electrostatic remover:

1) Electrostatic charges can be removed under the circumstances of inert gases such as $N_2$, Ar.

2) Remaining charged voltage can be maintained within ±5V nearly.

3) Electrostatic charges can be removed in a short time (about in a second nearly).

4) It is independent of circumstantial gases.

5) Because electrodes are not used, it can be dust free.

6) Electromagnetic noise is not generated.

7) Maintenance and conservation are not needed specially. (maintenance free)

The present invention may be modified and embodied in various forms, and it has been described and illustrated herein with reference to a specific embodiment thereof. However, it should be understood that this invention is not limited to the particular form as described above, and that this invention includes all modifications, equivalents and substitutes within the spirits and scope of this invention as defined in the "claims" attached here to.

THE EXPECTED EFFECTS OF THE PRESENT INVENTION

The present invention described above in detail has the following advantages.

First, the present invention removes electrostatic charges of powder, which is charged at the time of powder treatment or manufacturing processes and decreases charged voltage to below critical point of fire and in the process using powder, particularly such as feed plant, food processing plant, high polymer plastic manufacturing plant and timber processing mill prevents fire or explosion due to electrostatic discharges by floating dust and remaining electrostatic charges in the manufacturing processes of LCD, PDP and semiconductors and accordingly can prevent pattern destruction and absorption of dust particles due to electrostatic charges and therefore improves yield.

Second, a soft X-ray electrostatic remover according to the present invention is free from dust and ozone and has nearly no electrons and electromagnetic induction and can mitigate electrostatic voltage of a charged body up to a few voltages.

Third, a soft X-ray electrostatic remover using a ceramic tube has small bulk and high efficiency in generation of soft X-ray compared to a glass tube type X-ray tube generating same quantity of soft X-ray and can drive by small power source device and accordingly in the manufacturing processes of LCD, PDP and semiconductors can prevent destruction of elements caused by electrostatic charges and therefore improves not only yield but manufacturing technology of LCD and semiconductors.

Forth, electrostatic charges can be removed under the circumstances of inert gases such as $N_2$, Ar.

Fifth, Remaining charged voltage can be maintained within ±5V nearly.

Sixth, electrostatic charges can be removed in a short time. (About in a second nearly)

Seventh, it is independent of circumstantial gases.

Eighth, because electrodes are not used, it is dust free.

Ninth, electromagnetic noise is not generated nearly.

Tenth, maintenance and conservation are not needed specially. (maintenance free)

Eleventh, installing distance can be selected according to a charged state of a charged body and experiments show that electrostatic charges can be removed effectively up to the installing distance of 2,000 mm.

Twelfth, removing efficiency of electrostatic charges according to changes of the installing angle of an electrostatic remover has not a lot of change but are excellent relatively at an angle of below 115°.

Thirteenth, the maximum values of ion current generated from a soft X-ray electrostatic remover are +630 nA and −523 nA. The ion current increases up to the installing distance of 100 mm but decreases slowly at the above 100 mm and it decreases up to 17~~nA at 900 mm.

Fourteenth, a soft X-ray electrostatic remover according to the present invention does not cause pollution due to corpuscles and dust particles and is suitable for manufacturing processes of such as semiconductors, TFT-LCD or PDP.

Fifteenth, a soft X-ray electrostatic remover is effective under circumstances of atmospheric inert gases or having oxygen (i.e. air circumstance).

Sixteenth, a soft X-ray electrostatic remover neutralizes or mitigates electrostatic charges generated from manufacturing processes of an object needing electrostatic removing such as combustible powder, paints, LCD, PDP and semiconductors.

What is claimed is:

1. An electrostatic charge remover using soft X-rays, said remover comprising:

a head part neutralizing and weakening electrostatic charges of bodies, for removal of the electrostatic charges from the bodies, by generating soft X-rays having wavelengths in the range of 1.2 Å~1.5 Å with high energy from a soft X-ray tube that is an ion generating tube using thin film of Be evaporated with W as window material, and ionizing gas molecules directly and also removing electrostatic charges in atmosphere of inert gases ($N_2$, Ar);

a soft X-ray protecting part wrapping said head part and preventing that soft X-ray is leaked from said head part in order that a user of the electrostatic charge remover is not directly exposed to radiation;

a power controlling part being connected to said head part and said soft X-ray protecting part electrically and providing target voltage to control ion generation of a soft X-ray tube and a filament voltage of the soft X-ray tube, in order to control the ion generation so that said head part may generate soft X-rays appropriately, and wherein said remover removes the electrostatic charges on the surface of charged bodies by generating ions or electrons by ionizing gases surrounding charged bodies.

2. The electrostatic charge remover using soft X-rays as set forth in claim 1, wherein said soft X-ray protecting part is made of iron plates with thickness of 1 mm and an interlock switch controlling whether said power controlling part operates or not and a door putting odoff said interlock switch are installed in said soft X-ray protecting part for safety and in a state said door is opened, said head part does not generate soft X-ray.

3. The electrostatic charge remover using soft X-rays as set forth in claim 2, wherein said power controlling part controls anode voltage (target voltage) and filament current by using PWM modulator and pulse width controlling method and switches to a frequency of 30 KHz by constructing a half bridge circuit with FETs and the PWM modulator and the half bridge circuit are mounted for filament power and anode voltage generation respectively.

4. The electrostatic charge remover using soft X-rays as set forth in claim 3, wherein a voltage from an anode voltage generating part of said power controlling part is fed-back through tube voltage sensor and makes a target operate at a constant voltage of 9.5 KV, wherein a separated transformer, which is a constant voltage source device to a filament current, is fed-back through a filament current sensor and a tube current sensor and makes a filament operate at constant current of 150 μA, and current is fed-back through a tube current sensor, and wherein the generated quantity of the soft X-ray does not change according to a time of use.

5. The electrostatic charge remover using soft X-rays as set forth in claim 4, wherein said anode voltage generating part of said power controlling part comprises:

a high transformer generating high voltage;

a tube voltage sensor detecting high voltage generated by said high transformer;

a high voltage doubling rectifier, wherein voltage is fed-back to said rectifier through said tube voltage sensor and said rectifier operates at a constant voltage;

a transformer generating filament current;

a filament current sensor detecting filament current generated by said transformer; and a part inletting electric wires by insulating the electric wires from high voltage, and fixing a ceramic soft X-ray tube.

6. The electrostatic charge remover using soft X-rays as set forth in claim 1, wherein said soft X-ray tube consists of vacuum tubes for generating soft X-ray by generating ions and a ceramic tube is used for controlling heat generation of said soft X-ray tube.

7. The electrostatic charge remover using soft X-rays as set forth in claim 1, wherein the effective maximum installation distance of said electrostatic remover is 2000 mm.

8. A soft X-ray tube manufacturing method used in an electrostatic charge remover using soft X-rays removing electrostatic charges on the surface of a charged body by generating ions or electrons after irradiating lights with high energy (wavelength in the range of 1.2 Å~1.5 Å) and ionizing gaseous molecules directly to remove electrostatic charges in inert gases too and ionizing the surrounding gases near the charged body, said method comprising the steps of:

painting Mo—Mn paste with silk screen on ceramics to get metallizing coat of a ceramic tube and then heating Mo—Mn paste under hydrogenous circumstances at 1,350° C. for two hours and cooling said heated Mo—Mn paste;

plating non-electrolytic nickel on said metallized surface after said cooling;

deciding a filament's diameter according to the quantity of electrons to be generated after said nickel plating and turning the filament round a round steel bar predetermined times and pulling the bar out of the filament and coating the filament with LaBaO;

coating anode material on a Be window plate after said LaBaO coating, wherein the edge to be brazed is left not to be coated and accordingly filler metal consisting of Ag of 73% and Cu of 27% flows over said coated anode surface and prevents an efficiency of soft X-ray generation from dropping;

coating W over the Be window plate by using a Filtered Vacuum Arc Source (FVAS) coating device after said anode material coating;

performing high vacuum brazing by using an exclusive vacuum furnace and heating up temperature up to 900° C. by using a Mo heater and increasing degree of vacuum up to $4\times10^{-7}$ Torr by using a turbo molecular pump and a rotary pump;

making vacuum exhaustion of a tube up to a predetermined degree smoothly in case of brazing junction and making every material melt and form a body if temperature is over a melting point and embossing filler metal and brazing said embossed filler metal in order to keep the degree of vacuum as high as possible; and inserting a getter that is degassed at 450° C. as a non evaporable getter consisting of Zr—Ni—V—Fe material positioning near an inner cathode and activated in order to increase the life of tube.

9. The soft X-ray tube manufacturing method as set forth in claim 8, wherein said getter is fixed on the outer surface of a Ti cylinder of a cathode by welding when attaching a filament and said activated getter absorbs gases generated at the inner space of a closed tube and accordingly the degree of vacuum is kept for a long time and the life of said tube is prolonged.

10. The soft X-ray tube manufacturing method as set forth in claim 8, wherein the X-ray tube is manufactured such that a target voltage is 9.5 KV and a filament current of 150 μA are used by the X-ray tube in order to generate soft X-rays.

* * * * *